United States Patent [19]

Dabisch et al.

[11] 4,296,314

[45] Oct. 20, 1981

Best Available Copy

[54] NON-CONTACT COUNTER

[75] Inventors: Kenneth W. Dabisch; John S. Richards, both of Bolingbrook, Ill.

[73] Assignee: Rockwell International Corporation, Pittsburgh, Pa.

[21] Appl. No.: 97,472

[22] Filed: Nov. 26, 1979

[51] Int. Cl.[3] ..... G06M 7/00

[52] U.S. Cl. ..... 235/92 SB; 235/92 V

[58] Field of Search ..... 235/92 SB, 92 V, 92 PK, 235/98 C; 250/223 R, 222 PC

[56] References Cited

U.S. PATENT DOCUMENTS 3,813,523 5/1974 Mohan et al. ..... 235/92 SB 4,217,491 8/1980 Dufford et al. ..... 235/92 SB

*Primary Examiner*—Joseph M. Thesz

[57] ABSTRACT

An apparatus for the non-contacting counting of newspapers and the like which are being transported in shingled or overlapped relationship by a continuous conveyor system, which apparatus includes, a source of radiant energy positioned to direct a stream of energy against the surface of the overlapped moving papers, energy sensors positioned to receive energy reflected from the surfaces of the papers at a plurality of locations and means responsive to the output from the sensors to derive a signal indicative of the number of papers passing beneath the source of radiant energy.

2 Claims, 2 Drawing Figures

NON-CONTACT COUNTER

BACKGROUND OF THE INVENTION

In the production conveyance of articles by continuous conveyor systems wherein the articles are being moved as a continuous stream in overlapped or shingled or separated condition, it is necessary or at least highly desirable, to be able to count the number of articles while they are being conveyed. In the past, various types of counters have been used for determining the number of shingled articles passing a pre-selected location where the counting is effected. Some of these counters have utilized physical contact between the articles and the counting element while others have accomplished the counting through non-contact sensing means. The present invention is principally concerned with means for determining the number of newspapers that are being produced from a printing press and conveyed by a continuous conveyor to the mailroom facilities where the papers are stacked and collected into bundles of pre-selected numbers of paper.

Previously described counters from counting a flowing stream of newspapers are shown in U.S. Pat. Nos. 3,414,732, Stegena, 3,737,666, Dutro, 4,027,155, Rappaport and 3,834,289, Behrens et al. These patents are typical of some of the devices that have been used previously to count the papers in a travelling stream. They show, for example, that papers have been counted by physically contacting the newspapers in such a way that a beam of light existing between an emitter and a sensor is interrupted during passage of the papers. Specifically, see the Behrens et al and Dutro patents. The Rappaport patent also requires physical contact with the articles being conveyed and operates on the basis of a difference in the vertical height between the sensors and the light reflecting surface. The apparatus of Stegena on the other hand requires no physical contact, but, rather, depends upon a sensor which is capable of determining the differences between the light and the shaded areas present as the overlapped articles pass beneath the detector element.

It is a principle object of the present invention to provide an improved newspaper counter of the non-contact variety.

It is a further object of this invention to provide an improved newspaper counter that is less susceptible to variations in printing density than has been the case with previous sensors.

It is an additional object of this invention to provide an improved newspaper counter in which a multiplicity of non-contacting energy sensors are used to receive energy reflected from the surfaces of the travelling newspapers.

Other objects and advantages of this invention will be in part obvious and in part explained by reference to the accompanying specification and drawings in which:

DESCRIPTION OF THE INVENTION

As was stated earlier, the present invention is one for accurately counting newspapers in a flowing stream of papers as they are transported by a continuous conveyor from the press to the mailroom. The counting apparatus makes no mechanical contact with the stream of papers and delivers an output that is independent of printed material density.

Figure 1:
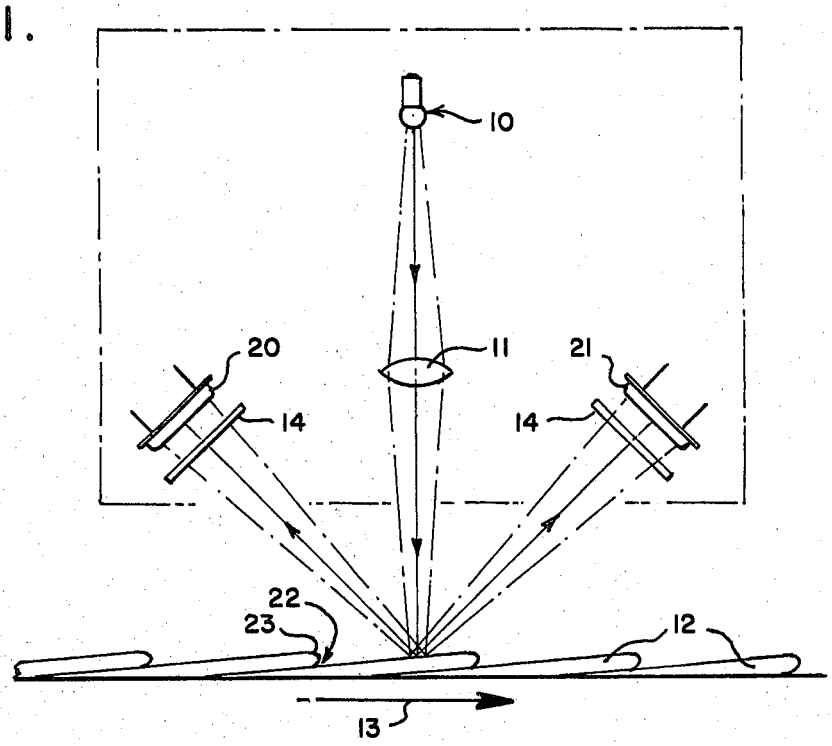
FIG. 1 is a schematic showing the manner in which the source of radiant energy and in which the energy sensors are mounted with respect to a travelling stream of papers.

Referring to FIG. 1 of the drawings, numeral 10 indicates a source of radiant energy that is disposed to one side of the large planar surfaces of the continuously moving stream of papers. Energy from the source of radiant energy 10 passes through a lens 11 which is positioned to focus the stream of energy against the surfaces of the papers 12 in a direction substantially normal to the direction in which the papers are moving, the direction of movement of papers 12 being indicated generally by the arrow 13. While a variety of different types of radiant energies can be used, it is here preferred to utilize energy in the infra-red spectrum as this effectively eliminates false readings caused by visible ambient light conditions. Visible light is filtered by optical filters 14. Energy sensors 20 and 21 are located on each side of the radient energy source 10 to receive energy that is reflected from the moving stream of papers 12. As viewed in FIG. 1, energy sensor 20 is located to the left of source 10 while sensor 21 is located to the right of source 10. The left and right relationships represent positions on the upstream and the downstream sides of the source 10 with respect to the direction of flow 13 of newspapers 12.

The purpose in providing lens 11 as part of the radiant energy source is to provide means whereby a focal point for the radiant energy is obtained that can be positioned at a pre-selected vertical position with respect to the leading edges and trailing portions of the newspapers 12. In practice, since the thickness of daily issues of newspapers vary widely, the focal point would normally be placed just at a point 22 on a surface of a leading newspaper which is located just ahead of the leading edge 23 of the next following newspaper copy. An advantage of the present apparatus is that once the focal point has been set to accommodate the thinnest issue of newspaper, it will be effective in counting all copies which are greater in thickness. This result is obtained even though for thicker editions of newspapers, the focal point is somewhat less than optimumly positioned.

The principle of operation involved is, briefly, a stream of radiant energy from source 10 is focused by lens 11 and directed against the surface of newspaper stream 12. Radiant energy sensors 20 and 21 located upstream and downstream of the radiant energy source, respectively, both receive energy that is reflected from the paper surfaces. As long as the radiant energy strikes a surface in the manner shown in FIG. 1, essentially the same quantities of energy will be sensed by sensors 20 and 21. However, as the stream progresses and the leading edge 23 is about to pass beneath the stream of focused energy, there will be a slight area of shadow created so that one of the sensors will receive less reflected energy than the other and an inbalance will be created within the registering system that ultimately will result in an output signal indicating the passage of a paper. Specifically, when a lap edge passes, the reflection to the front is increased due to specular reflection from the material surface at the lap edge, and reflection to the rear is decreased due to partial obscuring of the reflected energy by the lap edge.

Figure 2:
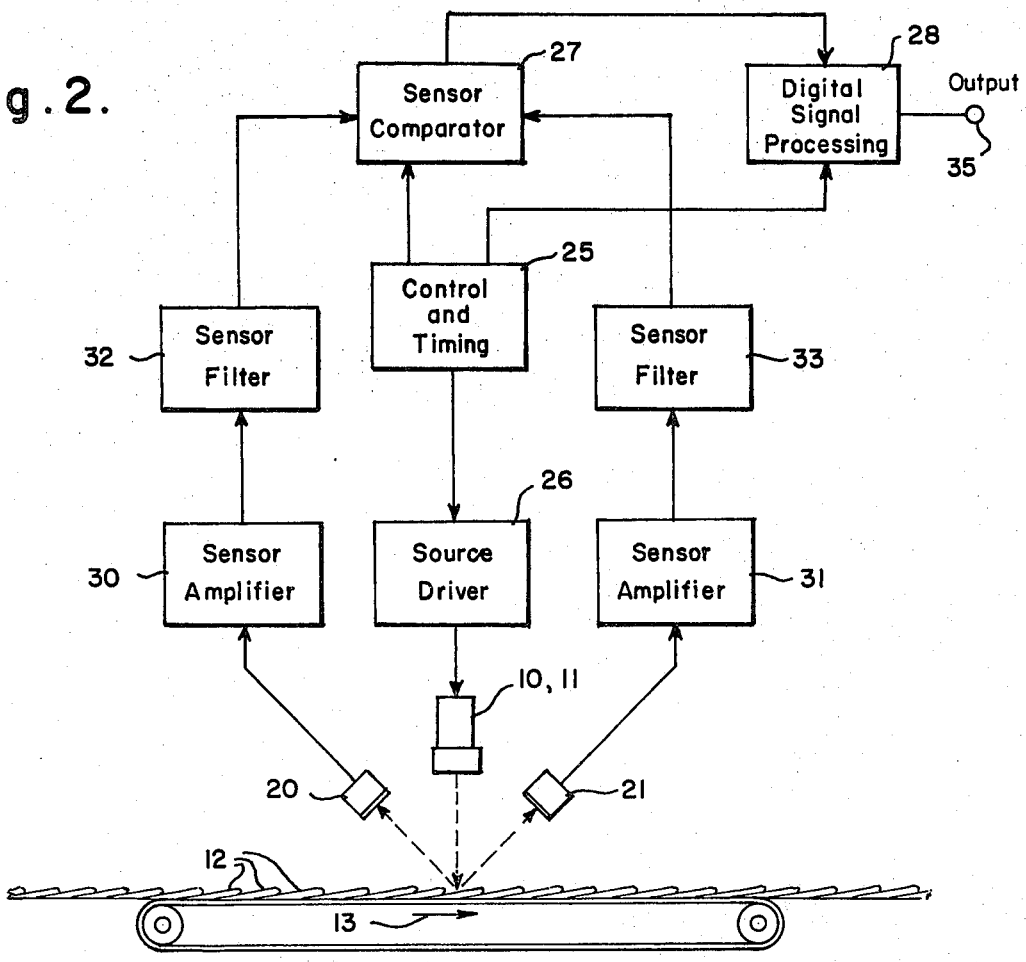
FIG. 2 is a schematic diagram showing the circuitry involved in the counting apparatus.

The manner in which the reflected energy is processed to derive a signal indicative of the passage of a paper can be seen by reference to FIG. 2 of the drawings. Referring to that figure, the numerals 10, 11, 12, 13, 20 and 21 represent the same elements described earlier in connection with FIG. 1. The source of radiant energy 10 is energized by control and timing apparatus 25 that provides a pulsed input to the amplifier or source driver 26 so that the source 10 will emit a stream of radiant energy that is pulsed or intermittent in operation. The control and timing element 25 also feeds timing outputs to sensor comparator 27 and to the digital signal processing unit 28. As the stream of radiant energy which is emitted from source 10 is reflected from papers 12 and collected by sensors 20 and 21, the sensors output to amplifiers 30, 31 and the signals from the amplifier are then forwarded to sensor filters 32 and 33 before being forwarded to comparator 27. The filters are included in the circuit merely to exclude extraneous signals from the system.

In the sensor comparator 27, amplified and filtered sensor outputs are compared to one another at times determined by the control and timing apparatus to coincide with the pulsing of the radiant energy source. The output of the sensor comparator changes when a specified degree of imbalance is detected between the sensor output signals. A sensor comparator output is forwarded to the digital signal processor 28 for each radiant energy pulse. When a specified number of successive comparator outputs of a given type are forwarded to the signal processors, an output signal 35 will be derived which is representative of the passage of a newspaper copy.

Since the present apparatus utilizes sensors located upstream and downstream of a source of radiant energy, the density of the printed material on the page can have no deleterious effect upon the accuracy of the counting process. In earlier apparatuses utilizing radiant energy sources and sensors, the presence of high density would often result in miscounting because the high density causes the apparatus to react in much the same way as the passing of a shadow area.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. Apparatus for counting newspapers moving in overlapped relationship in a continuous stream comprising:

(a) a source of pulsed radiant energy disposed to direct a stream of energy against the overlapped papers in a direction substantially normal to the direction in which the papers are moving;

(b) an energy sensor on each side of said radiant energy source to receive nonrefracted omnidirectional energy that is reflected from the stream of moving papers;

(c) sensor comparator means connected to each of said energy sensors;

(d) digital signal processing means connected to said sensor comparator means and responsive to the occurrence of a preselected number of consecutive validated pulses to deliver a count pulse indicating the passage of a paper past the energy source; and (e) control and timing connected to (i) said source of radiant energy, (ii) to said sensor comparator means and (iii) to said digital signal processing means to pulse said source of radiant energy and to provide a clock pulse to said digital processing means.

2. An apparatus as defined in claim 1 wherein said digital signal processing means requires the occurrence of a preselected number of coinciding pulses from said sensor comparator means and from said control and timing means to generate a count signal representing passage of a single paper past said source of radiant energy.

* * * * *